US005934933A

United States Patent [19]

Kordecki et al.

[11] Patent Number: 5,934,933

[45] Date of Patent: Aug. 10, 1999

[54] SNAP LOCK MEMBRANE CONNECTOR

[75] Inventors: David L. Kordecki; John Zdanys, Jr., both of Elkhart, Ind.

[73] Assignee: CTS Corporation, Elkhart, Ind.

[21] Appl. No.: 08/879,990

[22] Filed: Jun. 20, 1997

[51] Int. Cl.[6] ..... H01R 9/07

[52] U.S. Cl. ..... 439/495; 439/495; 439/271; 439/590; 439/77

[58] Field of Search ..... 439/495, 271, 439/590, 77

[56] References Cited

U.S. PATENT DOCUMENTS

| | | | |
|---|---|---|---|
| 4,235,500 | 11/1980 | Belopavlovich et al. | 439/495 |
| 4,477,137 | 10/1984 | Ayer | 439/590 |
| 4,815,981 | 3/1989 | Mizuno | 439/77 |
| 4,934,947 | 6/1990 | Brummans et al. | 439/77 |
| 4,948,378 | 8/1990 | Hoshino | 439/271 |
| 5,205,741 | 4/1993 | Steen et al. | 439/70 |
| 5,248,262 | 9/1993 | Busacco et al. | 439/66 |
| 5,269,705 | 12/1993 | Iannella et al. | 439/620 |
| 5,277,611 | 1/1994 | Berek et al. | 439/325 |
| 5,278,725 | 1/1994 | Konno et al. | 361/680 |
| 5,295,838 | 3/1994 | Walen et al. | 439/67 |
| 5,433,632 | 7/1995 | Cherney et al. | 439/495 |
| 5,509,827 | 4/1996 | Huppenthal et al. | 439/638 |

*Primary Examiner*—Paula Bradley
*Assistant Examiner*—Cecelia Wright Brown
*Attorney, Agent, or Firm*—Michael W. Starkweather; Mark P. Bourgeois; Daniel Tychonievich

[57] ABSTRACT

A device that allows for simple cost effective connections to flexible multilayered circuits and flexible membrane switches. The invention provides a connecting device that includes a housing that has a base and a closeable lid. At least one contact is attached to the housing. One end of the contact(s) extends beyond the housing and is suitable for making a connection to an electrical circuit. The other end of the contact(s) is positioned inside the housing for connecting to the flexible circuit board or flexible membrane. The lid can be fixed in the closed position whereby the end of the contact(s) inside the housing is compressed with the flexible circuit. The lid can be attached to the base with a hinge, and when the lid is closed it snap locks in place so that the contact(s) are firmly held to the conductive pads of flexible circuit. The membrane or flexible circuit is quickly and accurately positioned in place and securely held by using tabs on the housing which protrude through slots in the membrane or flexible circuit.

17 Claims, 3 Drawing Sheets

SNAP LOCK MEMBRANE CONNECTOR

BACKGROUND OF THE INVENTION

1. Field of the Invention

This invention generally relates to the art of electrical connectors and, particularly, to a connector with a locking housing for connecting flexible circuits or membranes having internal electrical traces to another electrical circuit.

2. Description of the Related Art

Various devices are known for making an electrical connection to flexible circuit board. If a single layered flexible circuit board is used then it typically will have electrical traces attached to conductive pads. On a single layered pad, the traces and conductive pads will be exposed to the surface. Connections to these pads may be made similar to ordinary non-flexible circuit boards, such as using spring biased contact members.

Connection to flexible circuit boards becomes more difficult, if the boards are stacked or layered together. Connection to exposed traces and conductive pads can be done in the same manner as for single layered boards, but connecting to electrical layers sandwiched between two or more boards requires a different approach since the conductive pads are not exposed to the surface. Similar considerations must also be made for flexible membrane switches, which have electrical conductors formed on the inside surfaces of two mating dielectric films.

One method of making connections to non-exposed electrical circuits is to drill holes or vias through the circuit board or dielectric film and fill the vias with a conductive material. Through the vias, electrical terminations that are not exposed can be routed to surfaces that are exposed and then connected in traditional manners. Additional traces and conductive pads may be placed on the exposed surface to properly connect the circuits routed through the vias. The problem with this approach is the increased complexity of manufacturing and associated costs.

Another approach to connecting the internal circuits is to cut one or more of the outside circuit boards or dielectric films short. In this way, the internal conductive pads can be exposed since they will project beyond the opposing circuit board that covers the majority of the circuit to be connected. Several layers of circuits can be connected in this manner as each consecutive layer is cut back a little further as in a step-like manner. This method has shortcomings also since it poses additional considerations of connecting to circuits on the bottom side of a cut back layer.

3. Related Art

Examples of patents that are related to the present invention are as follows, and each patent is herein incorporated by reference for the supporting teachings:

U.S. Pat. No. 5,205,741 is a connector assembly for testing integrated circuit packages.

U.S. Pat. No. 5,248,262 is a high density connector.

U.S. Pat. No. 5,269,705 is a tape filter and method of applying same to an electrical connector.

U.S. Pat. No. 5,277,611 is an arrangement for connecting an electrical connector to a printed circuit board.

U.S. Pat. No. 5,278,725 is a foldable electronic apparatus having a hollow hinge assembly through which a flexible cable is routed.

U.S. Pat. No. 5,295,838 has raised feature gold dot pressure interconnections of rigid- flex circuits and rigid circuit boards.

U.S. Pat. No. 5,433,632 is a flexible circuit connector.

U.S. Pat. No. 5,509,827 is a high density, high bandwidth coaxial cable, flexible circuit and circuit board connection assembly.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

It is a feature of the invention to provide a device that allows for simple cost effective connections to flexible multilayered circuits and flexible membrane switches.

An additional feature of the invention is to provide a connecting device that includes a housing that has a base and a closeable lid. At least one contact is attached to the housing. One end of the contact(s) extends beyond the housing and is suitable for making a connection to an electrical circuit. The other end of the contact(s) is positioned inside the housing for connecting to the flexible circuit board or flexible membrane. The lid can be fixed in the closed position whereby the end of the contact(s) inside the housing is compressed with the flexible circuit.

Another feature of the invention is to have the lid attached to the base with a hinge, and when the lid is closed it snap locks in place so that the contact(s) are firmly held to the conductive pads of flexible circuit.

A further feature of the invention is to provide a device that quickly and accurately positions the membrane or flexible circuit in place and securely hold it by using tabs on the housing which protrude through slots in the membrane or flexible circuit.

The invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. I t is important, therefore, that the claims be regarded as including such equivalent constructions insofar as they do not depart from the spirit and scope of the present invention.

Other features of the present invention will become more clear from the following detailed description of the invention, taken in conjunction with the accompanying drawings and claims, or may be learned by the practice of the invention.

Figure 1:
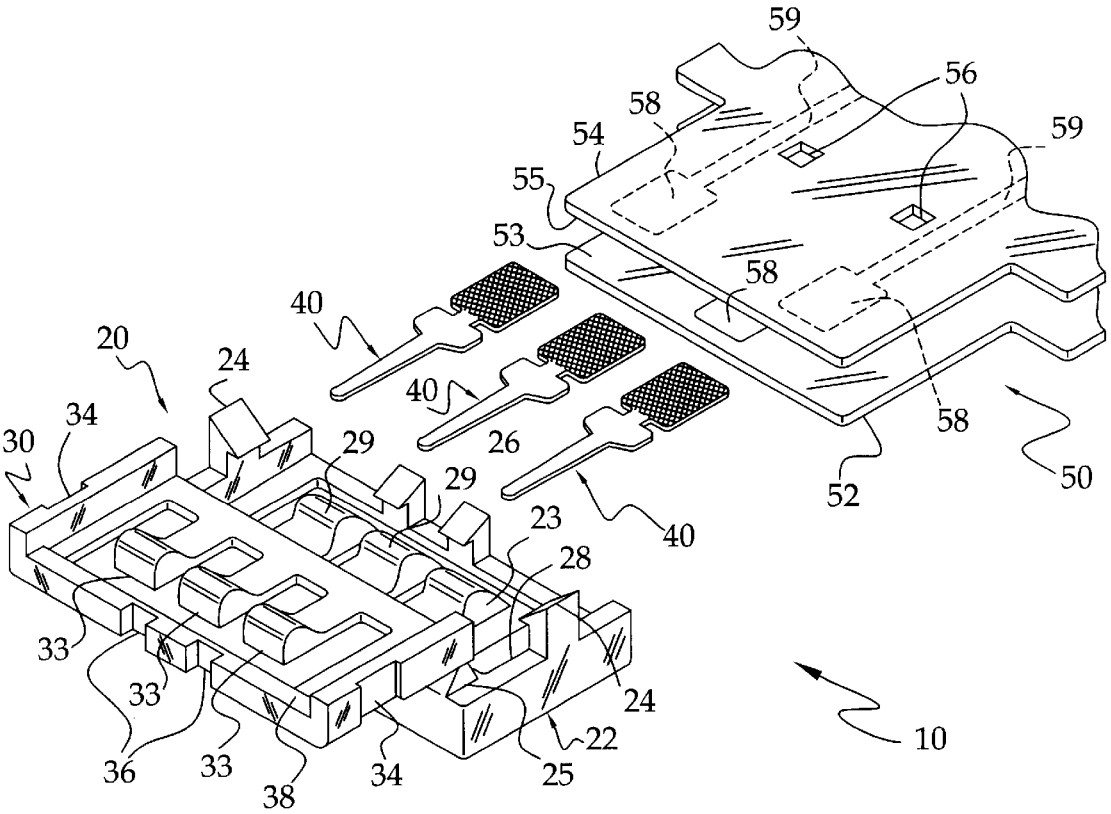
FIG. 1 is a perspective exploded view of the snap lock connector and a section of the membrane.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the use of the accompanying drawings. In the drawings like numbering represent like elements between the drawings.

DETAILED DESCRIPTION OF THE PREFERRED EMBODIMENT

The present invention provides a snap lock membrane connector for connecting multi-layered flexible circuits or flexible membrane films to a device such as a printed circuit board. Referring to FIG. 1, there is a snap lock membrane connector 10 depicted in an exploded view with a flexible membrane 50. Connector 10 includes a housing 20 having a base 22 and a lid 30. The housing is made of a dielectric material such as molded plastic. The lid 30 is attached to the base 22 by means of a hinge 25. The base 22 contains a cavity 28. Attached to the base 22 are fingers 23 that project into cavity 28. Lid 30 also contains a cavity 38, and attached to lid 30 is another set of fingers 33 that project into cavity 38. Fingers 23 and 33 form a compression means after closing the cover. The fingers 23 on base 22 oppose the fingers 33 on lid 30 when lid 30 is closed. The preferred embodiment also has tabs 26 on a front side of the base 22 and tabs 24 on the sides of base 22. When the connector is assembled, tabs 26 fit through slots 56 of flexible membrane 50 to both position the membrane and help hold it in place. The tabs 26 and slots 56 form major portions of a positioning means. When lid 30 is closed, tabs 26 fit into notches or indentions 36 located on the front of the lid. Similarly, tabs 24 fit into notches or indentations 34 located on the sides of lid 30. Tabs 24 and 26 and notches or indentions 34 and 36 form a locking means.

Flexible membrane 50 may comprise two opposing sheets of Mylar film 52 and 54 or any other flexible circuit board material. Slots 56 extend through both film sheets 52 and 54. At least one of the opposing inner surfaces 53 and 55 of film 52 and 54 respectively has electrical traces 59 placed thereon. The traces can be applied in any manner customary in the industry such as by employing thick or thin film techniques. At the end of membrane 50, traces 59 may be terminated with conductive pads 58 for making electrical connections thereto. Furthermore, at the end of membrane 50 where conductive pads 58 are located, the films 52 and 54 are not joined together. A space is left between films 52 and 54 so that contact terminal ends 42 may be placed in electrical contact with conductive pads 58.

Figure 2:
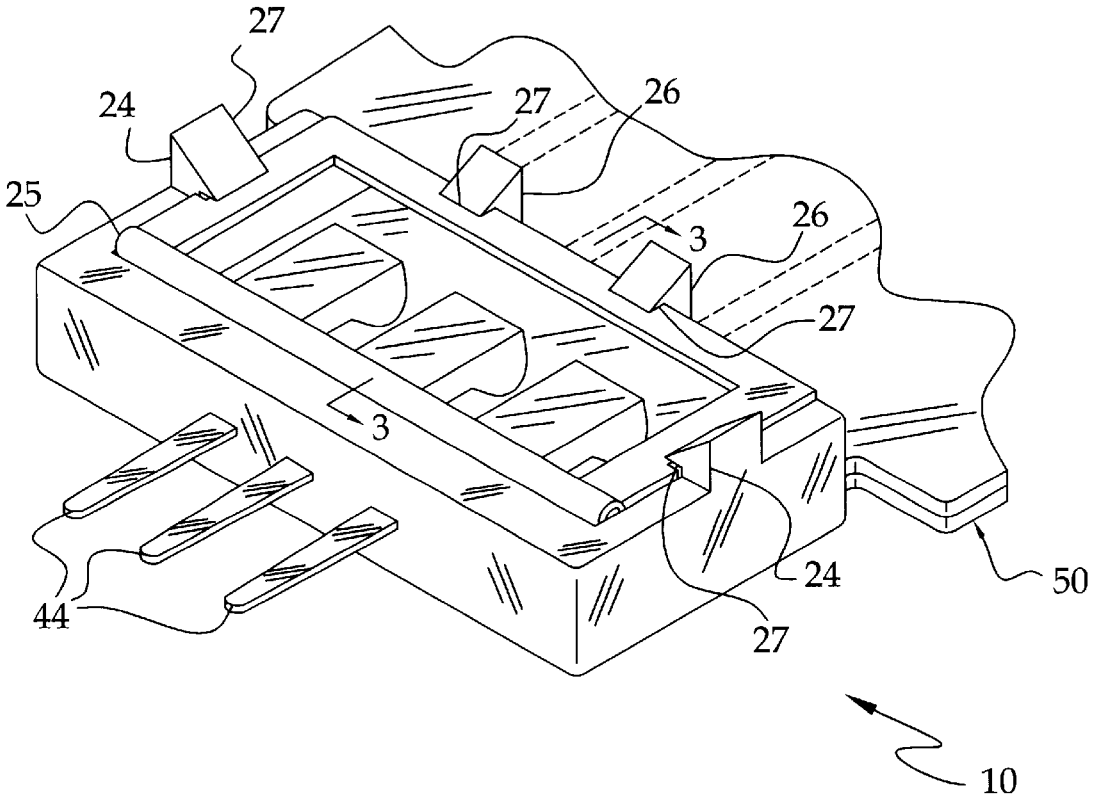
FIG. 2 is a perspective view of FIG. 1 with the snap lock connector closed about a flexible circuit.

Regarding FIG. 2, opposite contact ends 44 extend beyond the rear face of housing 20 to allow for external electrical connection to another circuit, such as a circuit board. Contact members 40 may be insert molded into housing 20 or held in place in holes placed through the housing by other suitable means such as epoxy. When lid 30 is closed, lips 27 on tabs 24 and 26 cause the housing to snap lock shut.

Figure 3:
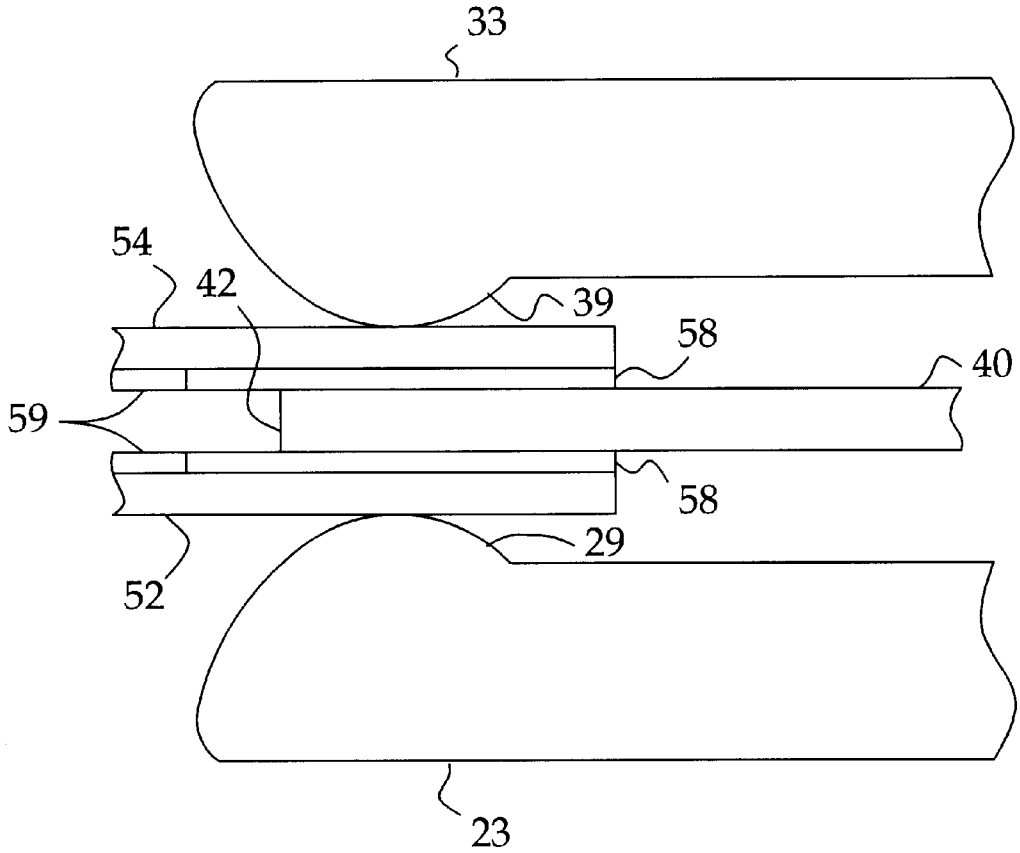
FIG.3 is a cross sectional view of FIG. 2 taken through the spring biased fingers.

As shown in the cross sectional view of FIG. 3, when lid 30 is closed, fingers 23 and 33 act as biased pressure springs to firmly hold terminal ends 42 to contact pads 58 between membrane films 52 and 54. Fingers 23 and 33 may have rounded protrusions 29 and 39 in order to better hold terminal end 42 between films 52 and 54.

Remarks About the Preferred Embodiment

One of ordinary skill in the art of designing and using connectors for flexible membranes or circuits will realize many advantages from using the preferred embodiment. For example, the invention provides a quick and inexpensive way to make electrical connections to a flexible circuit. A skilled artisan will also realize that the invention makes preparation of the flexible circuit for making connections much easier than previous methods since no vias are required, and extra traces or pads do not need to be provided on the outside of the film. Additionally, it is not necessary to cut or step back any of the layers of the flexible circuit board.

An additional advantage of the invention is that it is easily adapted to different configurations of flexible circuits, and the number, shape, and arrangement of the contacts can be varied as desired.

Variations of the Preferred Embodiment

Although the illustrated embodiments depict an arrangement of two films forming a membrane the preferred embodiment will work for multiple arrangements. For example, the invention will work with more than two layers of flexible circuits. Additionally, although the preferred embodiment discusses the use of pressure spring fingers extending into cavities of the housing lid and base, one skilled in the art will realize that there are other ways to hold the contacts between the flexible membrane. For example, protrusions 29 and 39 could be integrally formed in either one or both of the lid and base instead of using the biased pressure spring fingers. Screws or epoxy could also be used to hold the contacts in the membrane.

It is also contemplated to design the snap lock mechanism differently than the present tabs 24 and 26 and indentations 34 and 36 and still be within the scope of the invention. For example, it is equally likely that holes be placed in the lid and projections located on the base could extend through the holes. Another alternative would be to place the tabs 24 and 26 on lid 30 and the indentations 34 and 36 on base 22.

Another feature that could be changed without departing from the scope of the invention, would be to eliminate the slots in the film or to place notches at the sides of the film. Also, the lid could be totally separate from the base instead of being attached by hinges. Furthermore, the housing could even have a one piece design so that the flexible film is inserted into it.

While the invention has been taught with specific reference to these embodiments, someone skilled in the art will recognize that changes can be made in form and detail as discussed without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A connector for snap lock connecting to a flexible circuit having a first and second ply, comprising:

a) a housing having a base and a closeable lid;

b) a contact, attached to the housing, having:
1) a first end, extending beyond the housing, for connecting to a first electrical circuit; and
2) a second end, positioned inside the housing, for connecting to the flexible circuit; and c) compression means, coupled to the housing, for compressing the second end between the first and second ply to make an electrical connection between the contact and the flexible circuit when the lid is fixedly closed.

2. The connector for snap lock connecting to a flexible circuit as set forth in claim 1, wherein the compression means comprises biased fingers integrally formed in the base and lid.

3. The connector for snap lock connecting to a flexible circuit as set forth in claim 1, further comprising a locking means for locking the lid closed.

4. The connector for snap lock connecting to a flexible circuit as set forth in claim 3, wherein the locking means comprises tabs located on the base and indentations on the lid.

5. The connector for snap lock connecting to a flexible circuit as set forth in claim 1, further comprising a positioning means for positioning the flexible circuit in the connector.

6. The connector for snap lock connecting to a flexible circuit as set forth in claim 5, wherein the positioning means comprises tabs formed on the connector and slots located in the flexible circuit.

7. A combination of a connector and a flexible circuit, comprising:

a) the flexible circuit having:
1) at least two plies, each having a terminal end positioned within the connector; and
2) a conductive pad, located on the terminal end and formed on an inner surface of each of the plies; and b) the connector having:
1) a housing having a base and a closeable lid;
2) a contact, attached to the housing, having:
i) a first end, extending beyond the housing, for connecting to an electrical circuit; and
ii) a second end, positioned inside the housing, for connecting to the flexible circuit; and
3) compression means, coupled to the housing, for compressing the second end between the plies at the terminal end to make an electrical connection between the contact and the flexible circuit when the lid is fixedly closed.

8. The connector for snap lock connecting to a flexible circuit as set forth in claim 7, wherein the compression means comprises biased fingers integrally formed in the base and lid.

9. The connector for snap lock connecting to a flexible circuit as set forth in claim 7, further comprising a locking means for locking the lid closed.

10. The connector for snap lock connecting to a flexible circuit as set forth in claim 9, wherein the locking means comprises tabs located on the base and indentations on the lid.

11. The connector for snap lock connecting to a flexible circuit as set forth in claim 7, further comprising a positioning means for positioning the flexible circuit in the connector.

12. The connector for snap lock connecting to a flexible circuit as set forth in claim 11, wherein the positioning means comprises tabs formed on the connector and slots located in the flexible circuit.

13. A connector assembly for connecting to a flexible circuit, comprising:

a) a housing for connecting to the flex circuit;

b) the flexible circuit having at least two plies, each having a terminal end positioned within the housing; and c) a contact having a first end, that is located between the two plies and positioned inside the housing, and a second end that extends beyond the housing.

14. The connector assembly according to claim 13, wherein the housing has a base and a closeable lid.

15. The connector assembly according to claim 14, further comprising:

a plurality of fingers, attached to the base and the lid, for compressing the second end between the plies at the terminal end to make an electrical connection between the contact and the flexible circuit when the lid is fixedly closed.

16. The connector assembly according to claim 13, wherein a conductive pad is located on the terminal end and formed on an inner surface of one of the plies, wherein the pad is electrically coupled to the contact.

17. The connector assembly according to claim 16, wherein a second conductive pad is located on the terminal end and formed on an inner surface of another ply, wherein the second pad is electrically coupled to the contact.

* * * * *